US006066372A

United States Patent [19]

Miles

[11] Patent Number: 6,066,372

[45] Date of Patent: May 23, 2000

[54] SOLAR HEATED WINDSHIELD

[76] Inventor: Brent Miles, 236 S. Washington, Burns, Kans. 66840

[21] Appl. No.: 09/040,641

[22] Filed: Mar. 18, 1998

[51] Int. Cl.[7] ..... E06B 3/24

[52] U.S. Cl. ..... 428/34; 428/188; 428/69; 428/76; 428/72; 428/178; 296/211; 52/171.2; 52/171.3

[58] Field of Search ..... 296/84.1, 96.14, 296/211; 52/171.2, 171.3, 173.1, 171.4; 428/34, 38, 188, 69, 72, 76, 178

[56] References Cited

U.S. PATENT DOCUMENTS

| | | | |
|---|---|---|---|
| 1,703,355 | 2/1929 | Nielsen | 296/96.14 |
| 2,332,060 | 10/1943 | Colleran | 189/64 |
| 3,146,019 | 8/1964 | Peyches | 296/84 |
| 3,807,791 | 4/1974 | Boyer | 296/84 |
| 3,953,110 | 4/1976 | Charoudi | 350/161 |
| 3,958,245 | 5/1976 | Cherenko et al. | 343/713 |
| 4,039,720 | 8/1977 | Cherenko et al. | 428/425 |
| 4,086,595 | 4/1978 | Cherenko et al. | 343/713 |
| 4,232,080 | 11/1980 | Orain et al. | 428/215 |
| 4,554,199 | 11/1985 | Roentgen et al. | 428/194 |
| 4,744,844 | 5/1988 | Hurst | 156/101 |
| 4,923,757 | 5/1990 | O'Dwyer et al. | 428/425.6 |
| 4,925,725 | 5/1990 | Endo et al. | 428/156 |
| 5,070,230 | 12/1991 | Osada et al. | 219/203 |
| 5,173,586 | 12/1992 | Gold | 219/203 |
| 5,268,116 | 12/1993 | Fusiak et al. | 252/70 |
| 5,268,117 | 12/1993 | Fusiak et al. | 252/70 |
| 5,493,102 | 2/1996 | Takase et al. | 219/547 |
| 5,496,989 | 3/1996 | Bradford et al. | 219/497 |
| 5,565,271 | 10/1996 | Agethen et al. | 428/423.3 |
| 5,602,457 | 2/1997 | Anderson et al. | 320/2 |
| 5,622,580 | 4/1997 | Mannheim | 156/106 |
| 5,787,652 | 8/1998 | Tai | 52/171.3 |

*Primary Examiner*—Ellis Robinson
*Assistant Examiner*—Laura L. Lee
*Attorney, Agent, or Firm*—Jeffrey L. Thompson; Thompson & Thompson,P.A.

[57] ABSTRACT

A solar heated windshield comprises two matching glass sheets with a hollow interlayer therebetween for inhibiting frost or ice formation on the outer glass sheet by collecting and retaining solar energy within the interlayer. The inner sheet includes a tinted film such that solar energy passing through the windshield is partially deflected into the interlayer to warm the air contained therein. Deflected solar energy may also impinge on or be deflected into a reservoir containing a heat retentive and conductive liquid such as propylene glycol. Air within the interlayer will be warmed repetitively by the heated glycol through the fluid motion of convection. Heat may be transferred by convection to air throughout the interlayer or only to specifically focused areas.

4 Claims, 4 Drawing Sheets

SOLAR HEATED WINDSHIELD

BACKGROUND OF THE INVENTION

This invention relates to an automobile windshield construction and, more particularly, to a windshield having an interlayer containing a heat conductive substance for inhibiting frost formation on the windshield.

Automobiles that are parked in an unprotected weather environment accumulate snow, ice, or frost on their exposed surfaces in cold weather. The inconvenience of having to warm an automobile engine for a period of time or scrape a windshield prior to driving make the presence of such deposits on windshields extremely undesirable.

Various devices and compositions have been proposed for deicing a windshield. Although assumably effective in operation, such devices and compositions are effective only upon a driver starting the automobile's engine or personally applying the deicing substance to the exterior of the windshield. Thus, it is desirable to have a windshield construction which exhibits increased retention of solar energy for inhibiting or delaying accumulation of frost, ice, or snow upon the windshield.

SUMMARY OF THE INVENTION

In response thereto, I have invented multiple embodiments of a solar heated windshield having a hollow interlayer between two sheets of glass. The inner sheet is tinted to partially prevent solar energy from passing through the inner sheet. In one form of the invention, air within the interlayer will be warmed by the deflected energy to subsequently inhibit frost formation on the outside of the windshield.

In another form of the invention, the interlayer includes a reservoir containing a heat retaining liquid such as propylene glycol. In addition to warming air within the interlayer, solar energy deflected by the tinted inner sheet is absorbed by the glycol which acts as an energy storage medium. The solar energy is transferred by convection to air throughout the interlayer to inhibit frost or ice formation on the exterior glass sheet.

Propylene glycol (anti-freeze), in pure form or mixed with water, is frequently used in solar heating systems to transfer energy from a collection unit to a storage unit. Thus, heat absorbed by the glycol may be transferred to surrounding air through convection. Cooler air within the interlayer will descend to the reservoir while air heated through a convective current will rise within the interlayer to inhibit frost formation.

A third form of the invention includes several finger-like channels extending upward from the reservoir into the lower portion of the interlayer in which air convectively warmed by solar heated glycol will collect. This arrangement enhances inhibition of frost formation in specific regions of the windshield.

It is therefore a general object of this invention to provide an automobile windshield which collects and retains solar energy for inhibiting the accumulation of frost, ice, or snow on the windshield.

Another object of this invention is to provide an automobile windshield, as aforesaid, having an interlayer between two sheets of glass with a reservoir containing an energy retaining and conducting liquid.

Still another object of this invention is to provide an automobile windshield, as aforesaid, having a tinted interior glass for trapping solar radiation within the interlayer.

A further object of this invention is to provide an automobile windshield, as aforesaid, utilizing an energy retentive liquid that is non-toxic and substantially transparent.

A still further object of this invention is to provide an automobile windshield, as aforesaid, which inhibits frost formation without using electrical power or deicing compositions which must be consistently reapplied.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
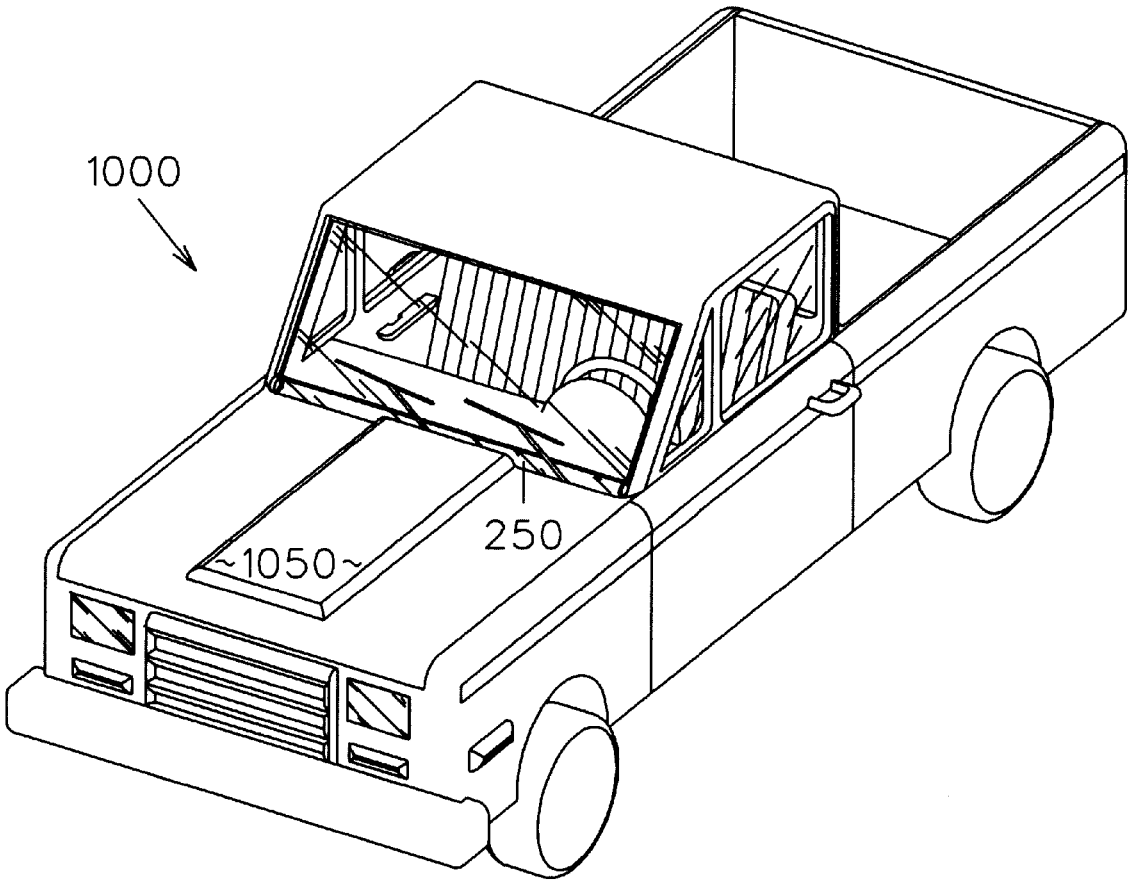
FIG. 1 is a perspective view of the solar heated windshield mounted to an automobile.
Figure 2:
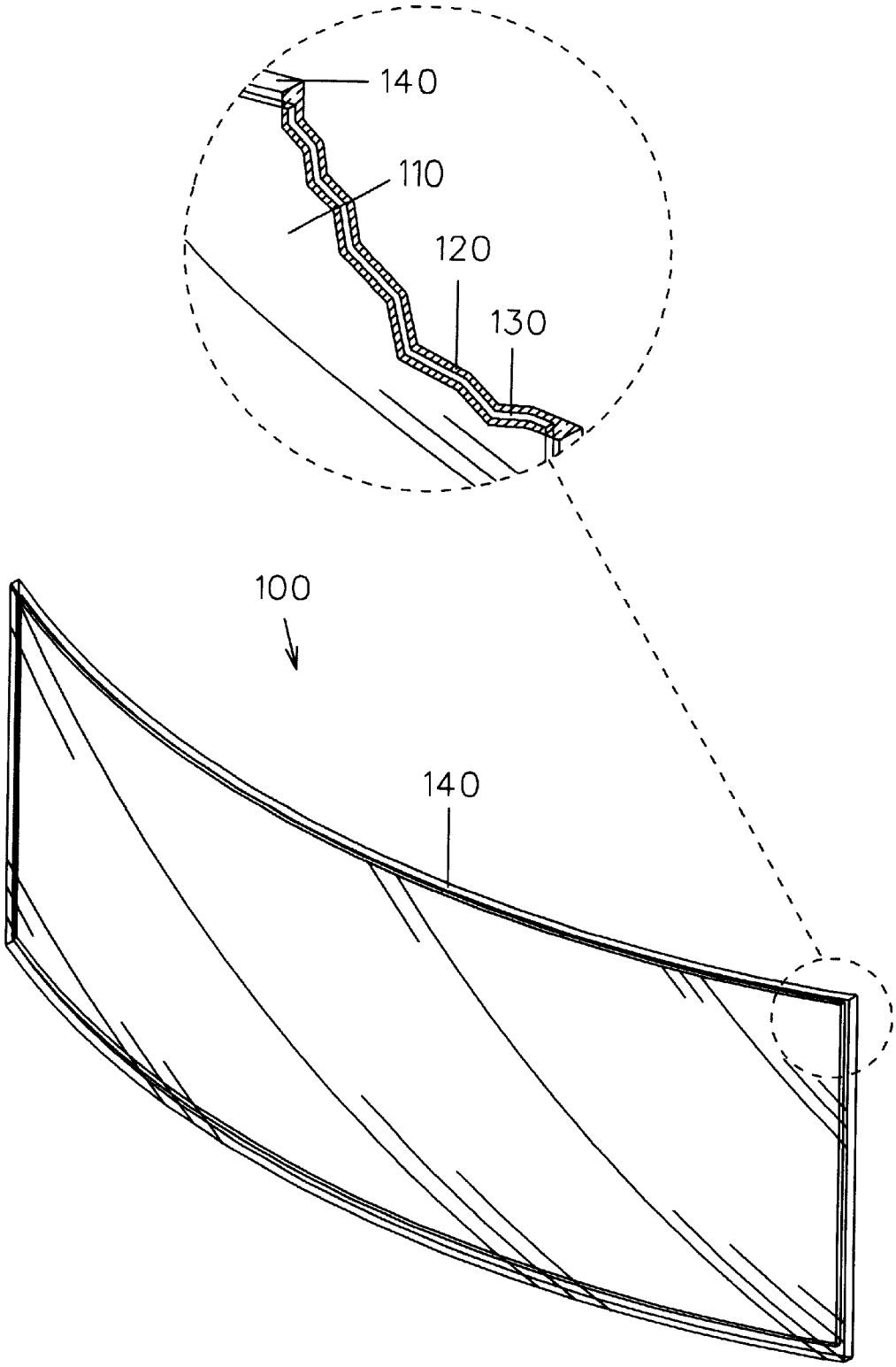
FIG. 2 is a perspective view of one form of the solar heated windshield with an enlarged isolated view of the bilayer glass construction having an interlayer.

Turning more particularly to the drawings, FIG. 2 shows a first embodiment of the solar heated windshield 100 comprising an outer glass sheet 110, an inner glass sheet 120 of matching arcuate curvature, and a thin hollow interlayer 130 sandwiched therebetween. The composition of glass sheets for windshields is known in the art. The glass sheets 110, 120 and interlayer 130 are bounded on all sides by an arcuate rectangular windshield frame 140 having an arcuate contour identical to the glass sheets 110, 120. Glass sheet 110 has an exterior surface facing the outside ambient air and an inside surface. Inner glass sheet 120 has a surface facing the inside surface of sheet 110 and an opposed surface facing the interior of the vehicle.

The inner glass sheet 120 is tinted 124 by laminating a dark colored film thereto preferably on the surface facing the inside surface of sheet 110. The darkest tinting is placed near the top and bottom of the inner sheet 120 where visibility through the windshield is not needed (FIG. 3C). Solar energy passing through the outer sheet 110 and interlayer 130 will be partially prevented by the tinting from passing through the inner sheet 120, but rather will be deflected back into the interlayer 130. Air within the interlayer 130 will thereby be heated for a heat exchange relationship with glass sheet 110 thereby subsequently inhibiting frost or ice formation on the windshield.

Figure 3B:
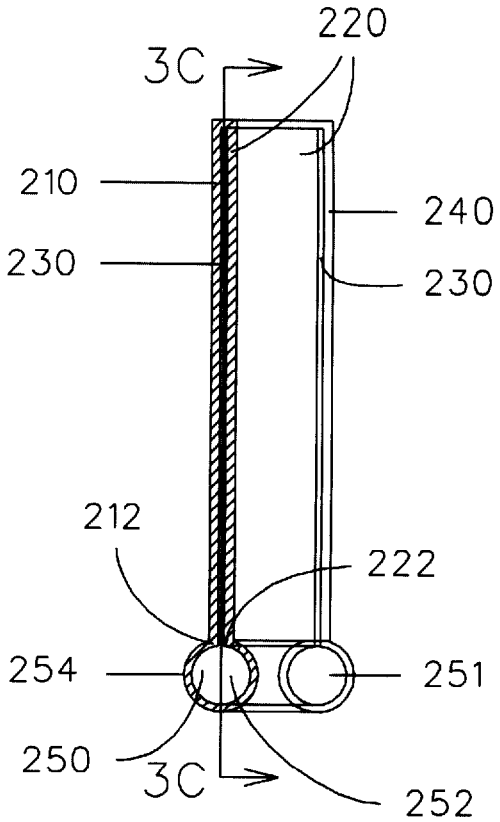
FIG. 3B is an enlarged sectional view of the solar heated windshield of FIG. 3A taken along plane 3B—3B.
Figure 3C:
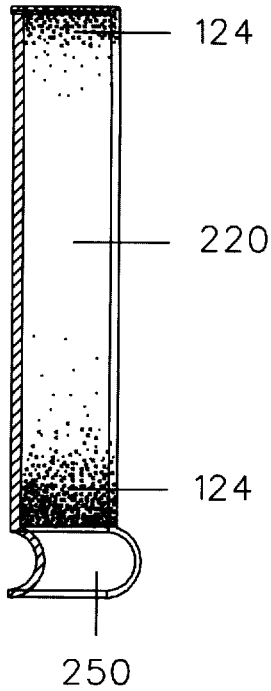
FIG. 3C is an enlarged perspective view of the section shown in FIG. 3B taken along plane 3C—3C in FIG. 3B.
Figure 3A:
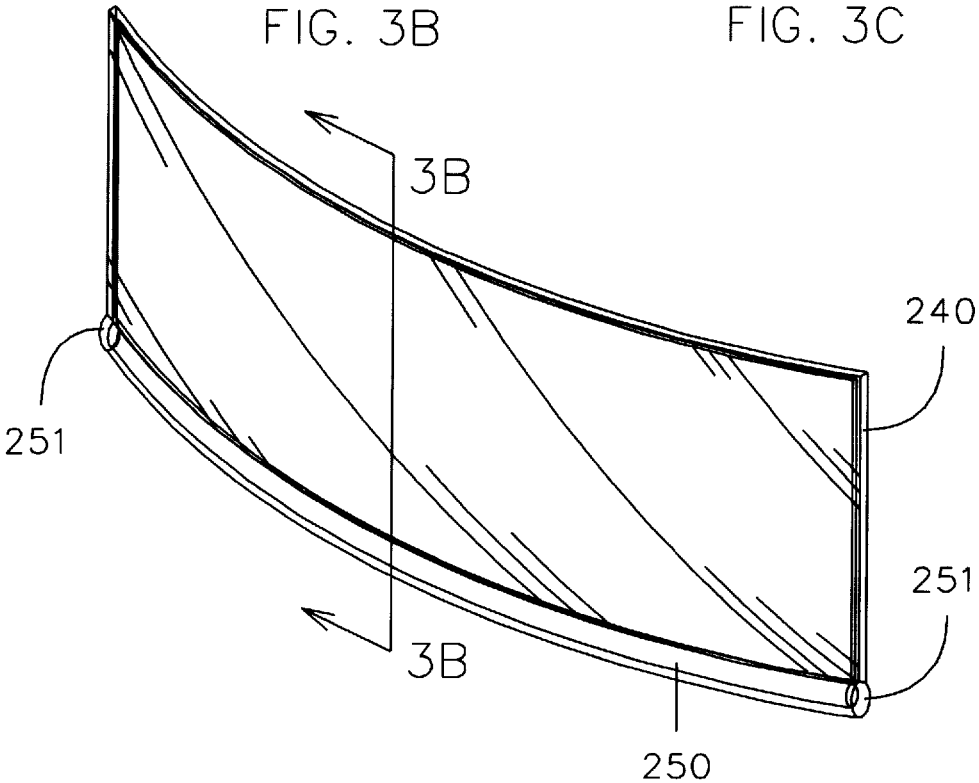
FIG. 3A is a perspective view of another form of the solar heated windshield having a reservoir.

Another embodiment of the invention is shown in FIGS. 3A–3C. This embodiment includes two sheets of glass 210, 220 and an interlayer 230 as described earlier. Top and lateral sides of the glass sheets 210, 220 and interlayer 230 are fixedly joined by an arcuate rectangular windshield frame 240. A hollow cylindrical reservoir 250 having end walls 251 is fixedly attached to lower edges 212, 222 of the glass sheets 210, 220, respectively, for holding a liquid such as propylene glycol having energy conductive properties.

The reservoir 250 presents an elongated slot 252 in an upper side 254 thereof which communicates with the interlayer 230 to receive solar energy deflected by the tinted inner sheet 220 and to warm the air within the interlayer 230 through convection. As cooler air within the interlayer 230 descends and contacts the heated glycol in the reservoir 250, the air will be warmed and will rise into the interlayer 230 to inhibit frost formation on the outer sheet 210. The fluid in reservoir 200 may also be heated by the solar energy directly impinging on the reservoir 250 for a heat exchange with the fluid therein. Also, the reservoir 250 being adjacent the hood 1050 of the vehicle 1000 may receive heat therefrom as the hood is being warmed by vehicle operation. Finally, reservoir 250 may be heated by heat emanating from the vehicle engine during or after operation.

Figure 4:
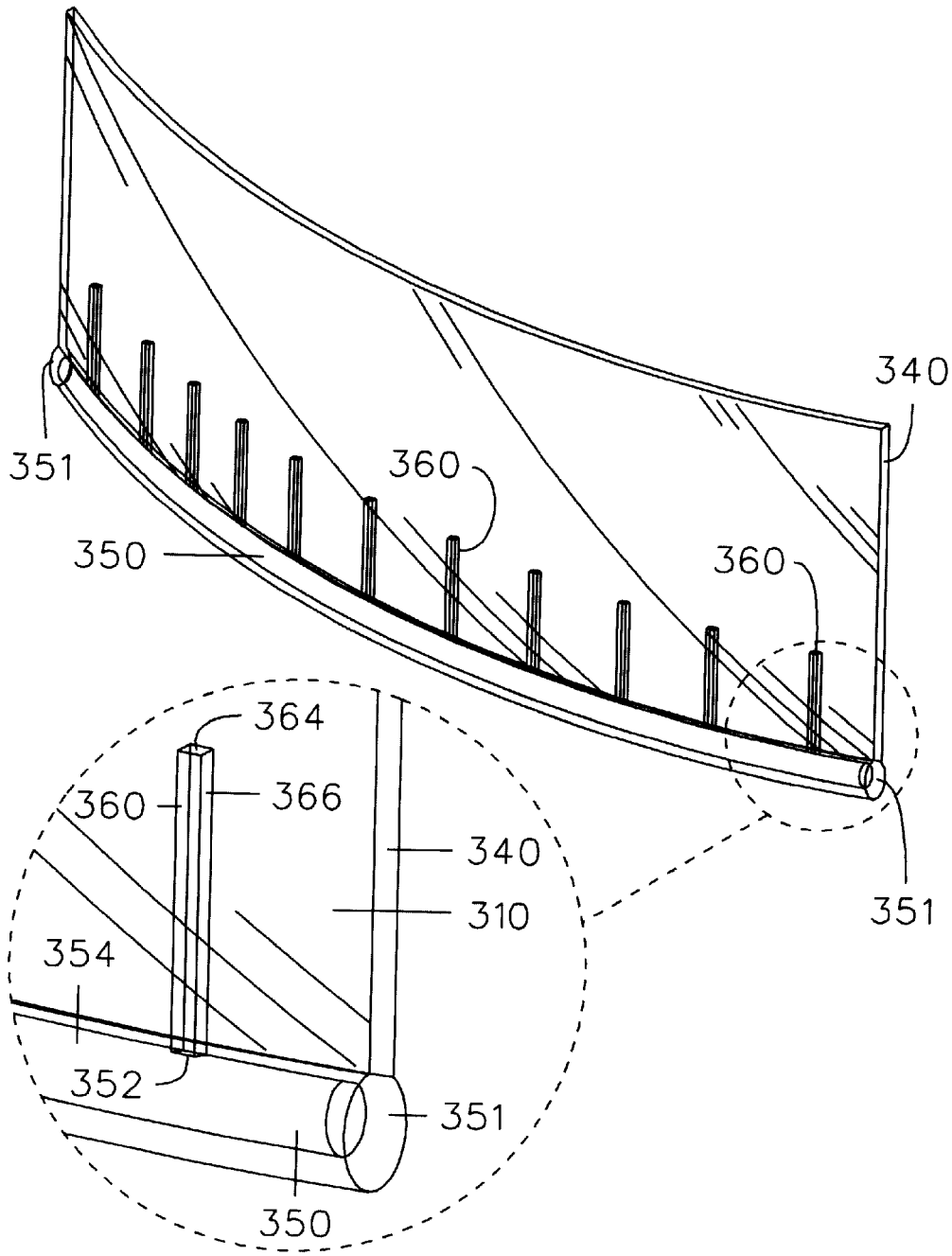
FIG. 4 is a perspective view of another form of the solar heated windshield having finger-like channels extending upward from the reservoir within the interlayer.

As shown in FIG. 4, another embodiment of the invention includes matching outer 310 and inner 320 sheets of glass with an interlayer 330 therebetween, said sheets 310, 320 and interlayer 330 being fixedly joined on top and lateral sides by a windshield frame 340 as described earlier. A cylindrical reservoir 350 having end walls 351 is fixedly attached to lower edges 312, 322 of the glass sheets 310, 320, respectively. The reservoir 350 presents a plurality of slots 352 in an upper side 354 thereof which communicate with bores in upwardly extending laterally spaced apart transparent channels in the form of shafts 360 having top 364 and side 366 walls, the shafts 360 extending within the interlayer 330 approximately one-third of the height thereof. Air within the interlayer 330 as well as glycol within the reservoir 350 may be warmed by solar energy deflected by a tinted inner sheet 320 or by other methods as described above. Warmed air within the interlayer 330 will inhibit frost formation across the entire outer glass sheet 310, whereas air within the shafts 360 will be convectively warmed by contact with the heated glycol to provide more focused inhibition of frost formation on the lower portion of the outer sheet 310.

Accordingly, it can be seen that the solar heated windshield can inhibit or delay the formation of frost or ice on a windshield by increasing windshield heat retention. Air warmed either by solar energy trapped within an interlayer or by contact with the heated glycol, solar or otherwise, acts to extend the period of time in which frost or ice is inhibited from forming on the windshield.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A solar heated vehicle windshield comprising:

a first plate of glass having a first exterior surface for facing the ambient air outside the vehicle and a second interior surface;

a second plate of glass having a first surface for facing said interior surface of said first plate and a second surface for facing an interior of the vehicle;

an interlayer of air space between said first and second plates;

means for maintaining said first and second plates in said facing relationship with said interlayer of air therebetween;

a reservoir;

a heat exchange fluid in said reservoir; and a plurality of spaced-apart channels, each channel attached to said reservoir and having a bore in communication with a corresponding slot in an upper wall of said reservoir, each said channel extending into said interlayer and having a closed top, said fluid capable of a heat exchange with air in said channels when solar energy from the ambient air passes through said first plate and into said interlayer for a heat exchange with said air in said interlayer.

2. The solar heated windshield as claimed in claim 1 wherein said reservoir includes a slot, said reservoir attached along an edge of said plates with said slot in communication with said interlayer.

3. The windshield as claimed in claim 1 wherein said channels are made of a transparent material, the solar energy passing through said first surface and into said channels.

4. An engine heated vehicle windshield comprising:

a first plate of glass having a first exterior surface for facing the ambient air outside the vehicle and a second interior surface;

a second plate of glass having a first surface for facing said interior surface of said first plate and a second surface for facing an interior of the vehicle;

an interlayer of air space between said first and second plates;

means for maintaining said first and second plates in said facing relationship with said interlayer of air therebetween;

a reservoir;

a heat exchange fluid in said reservoir; and a plurality of spaced-apart channels, each channel attached to said reservoir and having a bore in communication with a corresponding slot in an upper wall of said reservoir, each said channel extending into said interlayer and having a closed top, said fluid capable of a heat exchange with air in said channels upon an operation of the vehicle engine.

* * * * *